US009617999B2

(12) United States Patent
Schneider et al.

(10) Patent No.: US 9,617,999 B2
(45) Date of Patent: Apr. 11, 2017

(54) DOUBLE-WALL CONTAINMENT SHROUD OF A MAGNETIC COUPLING, IN PARTICULAR A MAGNETIC COUPLING PUMP

(71) Applicant: RUHRPUMPEN GMBH, Witten (DE)

(72) Inventors: Günther Schneider, Herne (DE); Michael Westib, Bochum (DE); Christian Jussen, Dortmund (DE); Katja Wischmann, Bochum (DE)

(73) Assignee: RUHRPUMPEN GMBH, Witten (DE)

( * ) Notice: Subject to any disclaimer, the term of this patent is extended or adjusted under 35 U.S.C. 154(b) by 0 days.

(21) Appl. No.: 14/412,944

(22) PCT Filed: Jun. 25, 2013

(86) PCT No.: PCT/DE2013/000331
§ 371 (c)(1),
(2) Date: Jan. 5, 2015

(87) PCT Pub. No.: WO2014/005564
PCT Pub. Date: Jan. 9, 2014

(65) Prior Publication Data

US 2015/0206637 A1 Jul. 23, 2015

(30) Foreign Application Priority Data

Jul. 6, 2012 (DE) ..... 20 2012 006 480 U

(51) Int. Cl.
*F04D 13/02* (2006.01)
*F04D 13/06* (2006.01)
*H01F 7/02* (2006.01)

(52) U.S. Cl.
CPC ..... *F04D 13/024* (2013.01); *F04D 13/025* (2013.01); *F04D 13/0626* (2013.01); *H01F 7/0242* (2013.01)

(58) Field of Classification Search
CPC .. F04D 13/025; F04D 13/024; F04D 13/0626; H01F 7/0242
See application file for complete search history.

(56) References Cited

U.S. PATENT DOCUMENTS 4,120,618 A * 10/1978 Klaus ..... F04D 1/06 310/156.26
4,752,194 A * 6/1988 Wienen ..... H02K 49/106 417/420

(Continued)

FOREIGN PATENT DOCUMENTS

DE 10 2009 022 916 A1 12/2010
DE 202012006480 U1 * 8/2012 ..... F04D 13/025

(Continued)

OTHER PUBLICATIONS

Patent DE202012006480U1 English-translation.*
International Search Report issued by the European Patent Office in International Application PCT/DE2013/000331.

*Primary Examiner* — Mohamad Musleh
(74) *Attorney, Agent, or Firm* — Henry M. Feiereisen LLC

(57) ABSTRACT

A magnetic coupling, in particular a magnetic coupling pump, includes an inner rotor and an outer rotor which each carry magnets. Disposed between the inner and outer rotors is a double-wall containment shroud, which includes an outer shroud and an inner shroud. Each of the inner and outer shrouds includes a flange, a middle section and a bottom section, wherein a gap is disposed between the middle section and the bottom section. The inner shroud is connected by its flange to the flange of the outer shroud. The gap is filled at least in sections with a solid material.

11 Claims, 2 Drawing Sheets

(56) References Cited

U.S. PATENT DOCUMENTS

| | | | | |
|---|---|---|---|---|
| 4,854,823 | A | 8/1989 | Hatting et al. | |
| 4,890,988 | A | 1/1990 | Krämer et al. | |
| 4,998,863 | A | 3/1991 | Klaus | |
| 5,336,996 | A * | 8/1994 | Rusnak | F04D 13/024 324/165 |
| 6,293,772 | B1 | 9/2001 | Brown et al. | |
| 2004/0184936 | A1 * | 9/2004 | Yanagihara | F04D 13/025 417/420 |
| 2011/0234035 | A1 | 9/2011 | Wittschier | |
| 2014/0001004 | A1 | 1/2014 | Schneider et al. | |
| 2014/0003747 | A1 | 1/2014 | Schneider et al. | |
| 2014/0003917 | A1 | 1/2014 | Schneider et al. | |

FOREIGN PATENT DOCUMENTS

| | | | |
|---|---|---|---|
| EP | 0 268 015 | A2 | 5/1988 |
| EP | 0 286 822 | B1 | 7/1991 |
| EP | 1 460 272 | A2 | 9/2004 |
| EP | 1 777 414 | A1 | 4/2007 |

* cited by examiner

DOUBLE-WALL CONTAINMENT SHROUD OF A MAGNETIC COUPLING, IN PARTICULAR A MAGNETIC COUPLING PUMP

CROSS-REFERENCES TO RELATED APPLICATIONS

This application is the U.S. National Stage of International Application No. PCT/de2013/000331, filed Jun. 25, 2013, which designated the United States and has been published as International Publication No. WO 2014/005564 and which claims the priority of German Patent Application, Serial No. 20 2012 006 480.0, filed Jul. 6, 2012, pursuant to 35 U.S.C. 119(a)-(d).

BACKGROUND OF THE INVENTION

The invention relates to a magnetic coupling, in particular a magnetic coupling pump, which comprises an inner rotor and an outer rotor which each carry magnets, between which a double-wall containment shroud is disposed, which comprises an outer shroud and an inner shroud, which each comprise a flange, a middle section and a bottom section, wherein a gap is disposed between the middle section and the bottom section, and wherein the inner shroud is connected by its flange to the flange of the outer shroud.

Magnetic coupling pumps are generally known, and described for example in DE 10 2009 022 916 A1. The pump output is transmitted from a drive shaft via a magnet-carrying rotor (outer rotor) contactless and essentially slip-free to the pump-side magnet carrier (inner rotor). The inner rotor drives the pump shaft, which is mounted in a sliding bearing lubricated by the conveying medium, i.e. in a hydrodynamic sliding bearing. The containment shroud with its cylindrical wall lies between the outer rotor and the inner rotor, i.e. between the outer and inner magnets. The containment shroud is connected with its flange to a pump component, for example a housing cover, and opposite thereto comprises a closed base. The containment shroud, i.e. the magnetic coupling pump, reliably separates the product space from the surroundings, so that the risk of a product escaping with all the associated unfavorable consequences can be excluded. A magnetic coupling pump is accordingly the combination of conventional pump hydraulics with a magnetic drive system. This system uses the forces of attraction and repulsion between magnets in the two coupling halves for the contactless and slip-free torque transmission. The containment shroud, which separates the product space and the surroundings from one another, is located between the two rotors provided with magnets. The magnetic coupling pump therefore offers great advantages especially when dealing with very valuable or very dangerous substances.

Containment shrouds can be made from various materials, such as for example metals of the most diverse alloy compositions, plastics or ceramics. Containment shrouds made of metal disadvantageously cause eddy current losses, plastic containment shrouds having only a limited resistance to temperature and pressure, which is particularly disadvantageous in the case of high medium temperatures and/or high pump pressures. To that extent, ceramic containment shrouds have become established in practice, containment shrouds made of glass (DE 10 2009 022 916 A1) having also become known recently.

Centrifugal pumps with a magnetic coupling, i.e. magnetic coupling pumps according to DIN EN ISO 2858 and DIN EN ISO 15783 and according to API 685, are equipped with single-wall containment shrouds in the standard, i.e. in a known manner. The containment shroud separates the product space in a leakage-free manner from the atmosphere and forms the static seal between the inner and outer magnetic rotor. In the cylindrical part, i.e. in its middle section, the containment shroud usually has a wall thickness of 1-2 mm. Damage to the containment shroud due to roller bearing damage on the outer magnetic rotor or sliding bearing damage in the region of the inner magnetic rotor can lead to the escape of conveying liquid into the atmosphere space of the intermediate skirt. In order to prevent an escape of conveying liquid, use is made of double-wall containment shrouds, amongst other things when pumping hazardous (e.g. toxic, carcinogenic, aggressive) conveying liquids.

Double-wall containment shrouds are known for example from EP 0 286 822 B1, but also from EP 0268 015. A double-wall containment shroud is known from EP 1 777 414 A1, the inner shroud and outer shroud whereof make contact with one another at least in the region of the cylindrical lateral surface, wherein a path network is constituted in this contact zone, in which path network there is disposed a liquid medium, i.e. a medium of sufficient viscosity, such as for example liquids or pasty materials, for example a heat-conducting oil.

Magnetic power losses of 10-15% have to be accepted when use is made of single-wall containment shrouds. This value can double when use is made of double-wall containment shrouds. For system-related reasons, the magnetic power losses are converted into heat in the case of metallic containment shrouds, said heat being discharged via the conveying product. For design-related reasons, however, the heat arising at the outer containment shroud cannot be completely discharged to the atmosphere. It is important here to discharge the heat between the outer and inner containment shroud due to the air-filled or evacuated intermediate space via heat-conducting products into the conveying product. The use of heat transfer oils or heat-conducting paste is known here. The main drawback here can be considered to be, for example, damage to the outer containment shroud with a corresponding escape of heat-conducting liquids or pastes from the intermediate space of the containment shrouds into the atmosphere with the risk of ignition or damage to the inner containment shroud due to incompatibility of the heat-conducting liquid paste with the conveying product, so that the latter is unusable on account of contamination. It is also a drawback, however, that special sealing measures, especially in the region of the abutting flanges of the outer and inner shroud, have to be taken, so that an escape of the liquid or paste introduced into the gap, even when the double-wall containment shroud is intact, is avoided. Additional sealing measures, however, mean additional cost, as well as the additional use of material. Furthermore, the special sealing also involves additional potential hazard, because the sealing measure can also fail, so that there is the risk of a shut-down, although the inner shroud and the outer shroud are actually still intact. Especially in the case of an inspection, in which the double-wall containment shroud possibly also has to be dismantled for control purposes, every effort has to be made to ensure that the liquid present does not get into the surroundings.

SUMMARY OF THE INVENTION

The problem underlying the invention is to provide a magnetic coupling, in particular a magnetic coupling pump of the type mentioned at the outset, wherein an improved containment shroud in a double-wall embodiment avoids at least the aforementioned drawbacks using straightforward means.

According to the invention, the problem is solved by a magnetic Coupling including an inner rotor and an outer rotor which each carry magnets, between which a double-wall containment shroud is disposed, which comprises an outer shroud and an inner shroud, which each comprise a flange, a middle section and a bottom section, wherein a gap is disposed between the middle section and the bottom section, and wherein the inner shroud is connected by its flange to the flange (18) of the outer shroud, wherein the gap is filled at least in sections with a solid material.

It should be pointed out that the features mentioned individually in the claims can be combined with one another in any technically reasonable manner and demonstrate further embodiments of the invention. The description characterizes and specifies the invention, in particular also in connection with the figures.

According to the invention, a magnetic coupling, in particular a magnetic coupling pump, is proposed, which comprises an inner rotor and an outer rotor which each carry magnets, between which a double-wall containment shroud is disposed, which comprises an outer shroud and an inner shroud, which each comprise a flange, a middle section and a bottom section, wherein a gap is disposed between the middle section and the bottom section, and wherein the inner shroud is connected via its flange to the flange of the outer shroud. Provision is advantageously made such that the gap is filled at least in sections with a solid material.

Due to the fact that the gap is filled at least in sections with a solid material, there no longer the risk of the latter mixing in a harmful way with the conveying medium in the event of a defect of the inner shroud or of it getting into the atmosphere in the case of a defect of the outer shroud. Although the possibility exists of a defective outer or inner shroud, the solid material remains in its position and does not become detached. It is also favorable that sealing measures at the flange connection of the two shrouds with one another can be dispensed with, since the solid material, due to its properties, does not have a tendency to leave its position, i.e. for example to flow out or to escape, as can be the case with liquids or pastes. This is because, in the case of solids, more precisely in the case of the solid material according to the invention, the viscosity is very high (i.e. difficult to determine), which in the sense of the invention means that the solid material is on no account free-flowing when the solid material is disposed in the gap.

It is expedient if the solid material is a heat-conducting material. It is favorable if the solid material is a heat-conducting plastic. The solid material can expediently be a silicone, or a heat-conducting silicone casing. It is possible for the solid material to be a heat-conducting foil.

The solid material can be disposed only in a specific region in the gap, i.e. in a region of the gap between the middle sections and/or between the bottom sections. The solid material can thus be disposed, for example, along the gap also interrupted in the latter. In a further expedient embodiment, the solid material fills the entire gap throughout between the mutually opposite middle sections or bottom sections of the inner shroud and the outer shroud. In a further preferred embodiment, provision can be made for the solid material to be disposed throughout in the entire gap between the middle sections and the bottom sections.

In an expedient embodiment, the solid material fills the gap at least in sections viewed in the axial direction along the gap, wherein the solid material completely fills the gap in this region viewed in the radial direction. In this regard, the solid material can be considered as a kind of bridge between the inner circumference of the outer shroud and the outer circumference of the inner shroud. The term "along with the gap in the axial direction" includes, in the sense of the invention, both the gap between the middle sections and between the preferably curved bottom sections, wherein the term "radial direction" relates, in the sense of the invention, to the amount of the gap between the inner diameter of the outer shroud and the outer diameter of the inner shroud, and indeed both of the middle section as well as of the preferably curved bottom section.

It is expedient, in the sense of the invention, if the solid material is connected to the inner shroud or at least lies adjacent to its outer circumference, which relates to a pre-assembly position. In the assembled state, the solid material is connected at least in sections, as explained above, both to the inner circumference of the outer shroud and to the outer circumference of the inner shroud. For the connection of the solid material to the inner shroud, provision can be made such that the solid material is shrunk on the inner shroud in the manner of a shrink-on tube. For assembly of the inner shroud into the outer shroud, provision is expediently made such that the outer shroud first has a larger inner diameter than required, which is achieved by heating. When the outer shroud cools down after the assembly has taken place, it has the inner diameter required according to the design, and with said inner diameter is connected at least in sections, interrupted or completely, to the solid material.

Since, according to the invention, solid material is disposed in the gap, the flange connection between the inner shroud and the outer shroud does not require any additional sealing measures whatsoever. In this regard, the flange connection can for example comprise a screw connection with no regard to possibly escaping liquid media, wherein a seal, e.g. an O-ring seal, can of course optionally be provided. Since a welded joint or a temperature-susceptible adhesive joint, for example, can thus be dispensed with, many diverse options arise with regard to the material to be selected for the outer shroud and the inner shroud, since dissimilar materials can also be selected. Thus, for example, the inner shroud can be constituted by a nickel-based alloy, for example a Hastelloy®, the outer shroud being able to be constituted by a titanium alloy. Especially when the outer shroud is constituted by a titanium alloy, a wide range of advantages arises, since this material has a high electrical resistance, a high strength and good thermal conductivity, wherein a considerable reduction in the magnetic power loss results overall, which has an advantageous effect on the energy efficiency of the magnetic coupling pump. The wall thickness of the outer shroud in the middle section can also be reduced on account of the properties of the titanium alloy and can for example amount to 0.5 mm, wherein a further reduction of the magnetic power loss then results. The stated amount is of course only by way of example and on no account limiting.

The solid material is constituted as separate material from the two shrouds, although being connected to preferably both shrouds, and has a dual function. On the one hand, the solid material has a stability effect on the two containment shrouds, which in the respective middle section and bottom section are advantageously spaced apart from one another completely free from contact. On the other hand, the solid material assumes the function of the heat transfer from the outer shroud to the conveying medium.

With the invention, therefore, a double-wall containment shroud is made available, the outer shroud and inner shroud whereof are individually replaceable independently of one another, since the flange-screw connection alone has to be released. Thus, if only one of the two shrouds is defective, then only the latter has to be replaced, which has a particularly favorable effect especially with the high-cost shroud materials used. In addition, the inner shroud and the outer shroud do not have contact zones either in the middle section or in the bottom section. On the contrary, the outer shroud and the inner shroud are kept completely free from contact along the gap in the middle and bottom section viewed in the axial direction, wherein a path network to be introduced in the inner circumference of the outer shroud also becomes unnecessary.

BRIEF DESCRIPTION OF THE DRAWING

Further advantageous embodiments of the invention are disclosed in the sub-claims and the following description of the figures. In the figures:

DETAILED DESCRIPTION OF PREFERRED EMBODIMENTS

Identical parts are always provided with the same reference numbers in the various figures, for which reason the latter are usually described only once.

Figure 1:
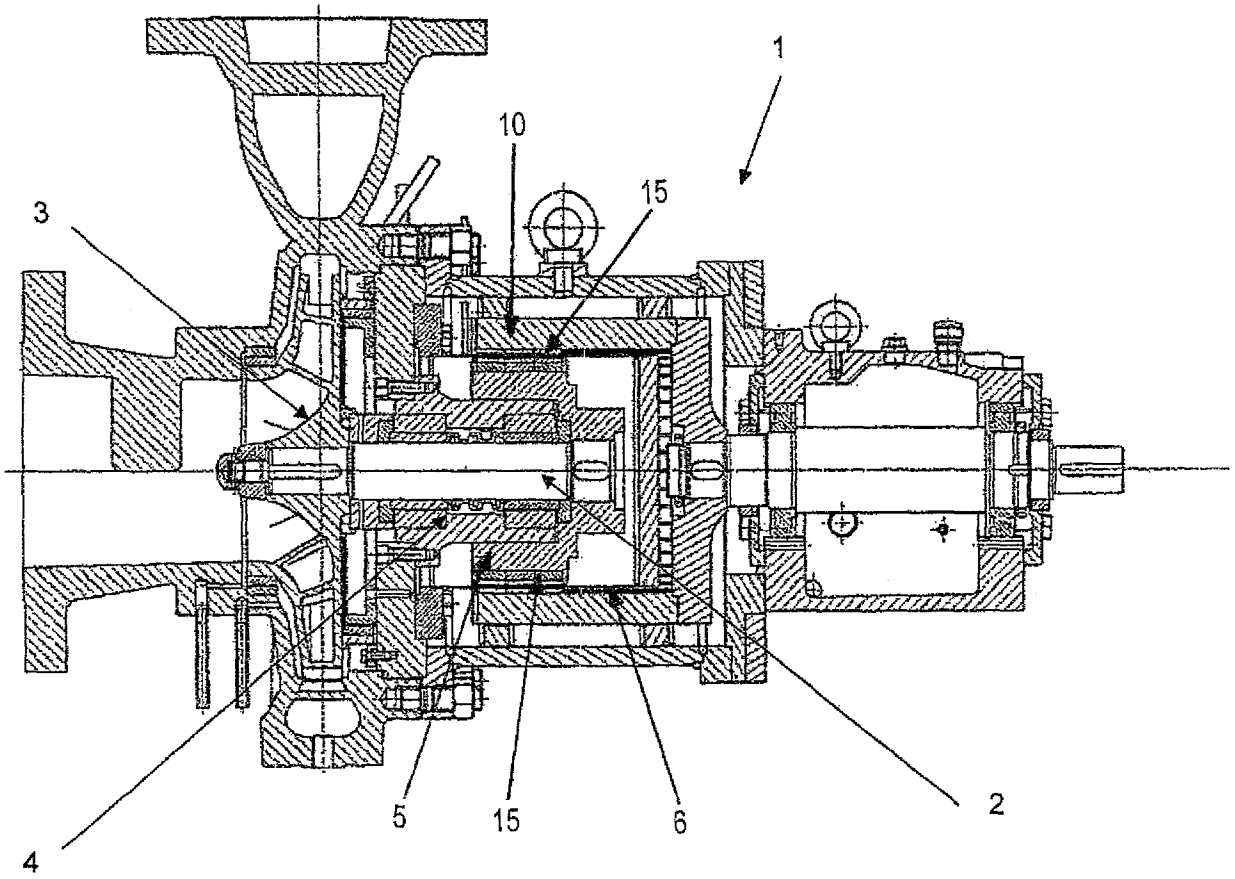
FIG. 1 shows a magnetic coupling pump in a cross-sectional representation.

FIG. 1 shows a magnetic coupling pump 1 which comprises an inner rotor 5 and an outer rotor 10, which each carry magnets 15, and with a pump shaft 2, e.g. as special steel shaft 2, which carries an impeller 3 and which is mounted in a hydrodynamic sliding bearing 4, wherein hydrodynamic sliding bearing 4 can be externally lubricated by the conveying medium, but also by another, product-compatible fluid. Disposed between the inner rotor 5 and the outer rotor 15 is a containment shroud 6, which will be described in greater detail in FIG. 2. Magnetic coupling pump 1 is known per se, for which reason it will not be described in greater detail.

Figure 2:
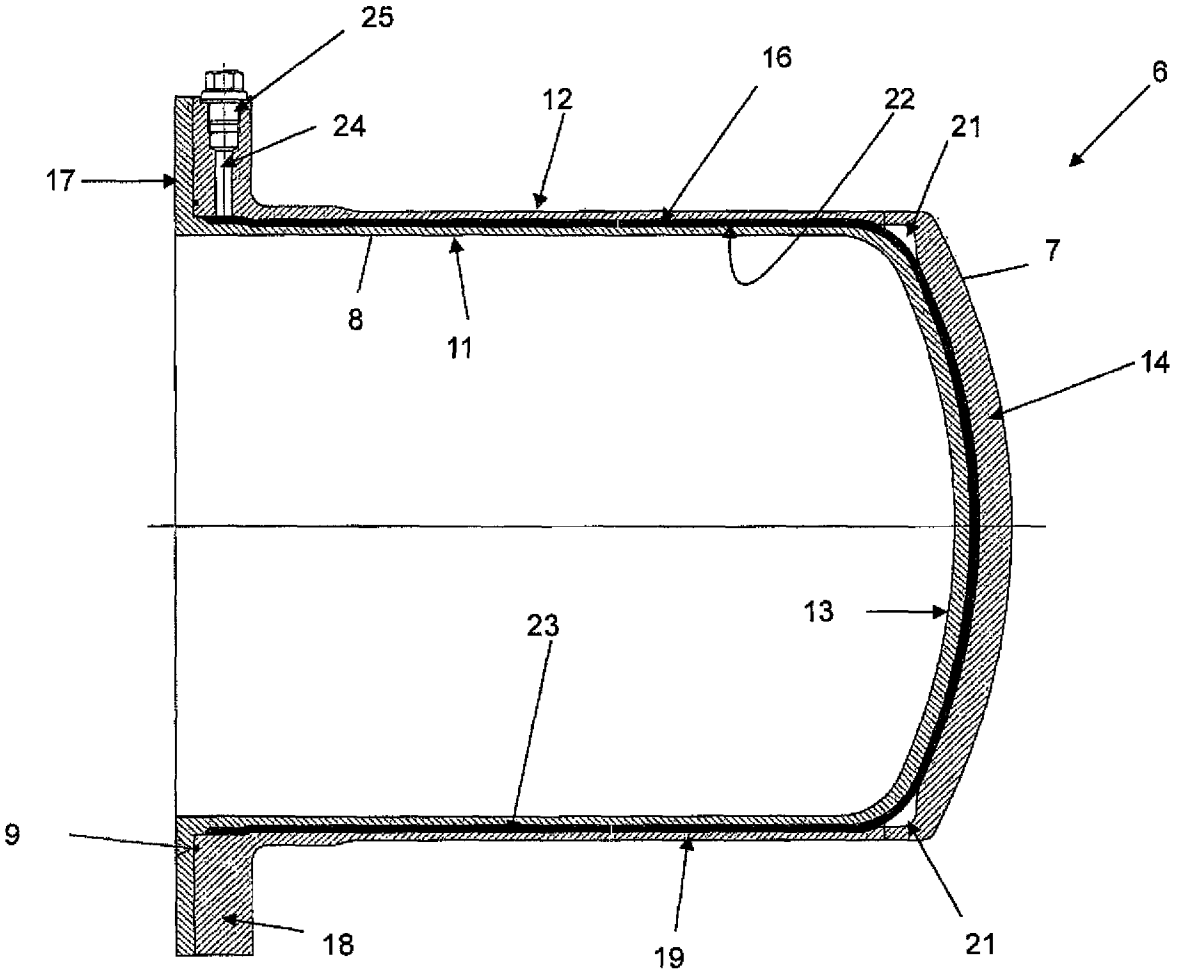
FIG. 2 shows a double-wall containment shroud of a magnetic coupling pump in a cross-sectional representation.

FIG. 2 shows the containment shroud 6 of magnetic coupling pump 1 from FIG. 1, wherein containment shroud 6 is constituted as a double-wall containment shroud 6, which comprises an outer shroud 7 and an inner shroud 8, which each comprise a flange 17 and 18, a middle section 11, 12 and a bottom section 13, 14, wherein a gap 16 is disposed between respective middle section 11, 12 and respective bottom section 13, 14. Inner shroud 8 is connected by its flange 17 to flange 18 of outer shroud 7. Provision is advantageously made such that gap 16 is filled at least in sections with a solid material 19. Solid material 19 is indicated as a continuous line in FIG. 2.

Respective middle section 11, 12 is, in each case viewed in cross-section, constituted cylindrical, wherein bottom section 13, 14 adjoining respective middle section 11, 12 is constituted curved. Both curvatures are orientated identically.

As is represented by way of example, gap 16 is filled throughout and completely with the solid material 19 viewed both in the axial direction and in the radial direction. Only in pocket 21, which is present in each case for production-related reasons between a transition region of bottom section 14 of outer shroud 7 to its middle section 12, is no solid material disposed.

A screw connection (not represented) is provided for the connection of the two flanges 17 and 18. Since, according to the invention, solid material 19 is disposed in gap 16, the flange connection between inner shroud 8 and outer shroud 7 does not require any additional sealing measures whatsoever, an optional seal 9, for example in the embodiment as an O-ring seal 9, being disposed in FIG. 2.

Solid material 19 is disposed and constituted in such a way that inner circumference 22 of outer shroud 7 and outer circumference 23 of inner shroud 8 are connected to solid material 19.

As can be seen in FIG. 2, respective middle section 11, 12 and respective bottom section 13, 14 are kept completely free from contact. Only flanges 17 and 18 are in mutual contact.

FIG. 2 also shows a test connection 24 with a corresponding testing device 25, which is disposed in flange 18 of outer shroud 7, so that a defective inner shroud 8 and/or outer shroud 7 can be detected, wherein a mass-pressure change of solid material 19 can be detected in the event of a defective inner shroud or outer shroud.

Solid material 19 in gap 16 is a material absolutely incapable of flowing in the state introduced into gap 16 and filling the latter, wherein the solid material is preferably a solid plastic or a silicone.

Solid material 19 can be shrunk onto outer circumference 23 of inner shroud 8, for example in the manner of a shrink-on tube. It is also possible to introduce silicone, as the solid material, in assembled double-wall containment shroud 6, which is free-flowing only for filling purposes, but then solidifies to form a permanently elastic material completely incapable of flowing.

The invention claimed is:

1. A magnetic coupling, comprising:

an inner rotor carrying magnets;

an outer rotor carrying magnets;

a double-wall containment shroud disposed between the inner and outer rotors and including an outer shroud and an inner shroud, each of the inner and outer shrouds having a flange, a bottom section, and a middle section between the flange and the bottom section, with the flange of the inner shroud connected to the flange of the outer shroud, said the inner and outer shrouds being composed of metal and defining a gap there between in an area of the middle sections and the bottom sections; and a solid material filled in the gap at least in one section thereof, wherein the solid material is a heat-conducting plastic providing a heat transfer from the outer shroud to a conveying medium.

2. The magnetic coupling of claim 1, constructed in the form of a magnetic coupling pump.

3. The magnetic coupling of claim 1, wherein the solid material is a heat-conducting silicone.

4. The magnetic coupling of claim 1, wherein the solid material is a heat-conducting foil.

5. The magnetic coupling of claim 1, wherein the solid material is disposed in the gap in at least one section between the middle section of the inner shroud and the middle section of the outer shroud.

6. The magnetic coupling of claim 1, wherein the solid material is disposed in the gap in at least one section between the bottom section of the inner shroud and the bottom section of the outer shroud.

7. The magnetic coupling of claim 1, wherein the solid material is disposed throughout in the gap between the middle section of the inner shroud and the middle section of the outer shroud.

8. The magnetic coupling of claim 1, wherein the solid material is disposed throughout in the gap between the bottom section of the inner shroud and the bottom section of the outer shroud.

9. The magnetic coupling of claim 1, wherein the gap is filled throughout with the solid material in its entirety.

10. The magnetic coupling of claim 1, wherein the solid material is connected to an outer circumference of the inner shroud and to an inner circumference of the outer shroud.

11. The magnetic coupling of claim 1, wherein the inner shroud is made of nickel-based alloy, and the outer shroud is made of titanium alloy.

* * * * *